US008800799B1

(12) United States Patent
Hawker et al.

(10) Patent No.: US 8,800,799 B1
(45) Date of Patent: Aug. 12, 2014

(54) SECURE CONTAINER

(76) Inventors: Christopher Hawker, Columbus, OH (US); Jessica Moreland, Columbus, OH (US); Christopher Trunek, Auburn Township, OH (US)

( * ) Notice: Subject to any disclaimer, the term of this patent is extended or adjusted under 35 U.S.C. 154(b) by 162 days.

(21) Appl. No.: 12/880,005

(22) Filed: Sep. 10, 2010

Related U.S. Application Data

(60) Provisional application No. 61/241,417, filed on Sep. 11, 2009.

(51) Int. Cl.
*B65D 25/24* (2006.01)

(52) U.S. Cl.
USPC ..... 220/481; 220/480; 220/476; 403/348; 403/353; 248/222.52; 109/51; 109/52

(58) Field of Classification Search
USPC ..... 220/751, 605, 476, 480, 481; 109/51–52; 70/57, 58, 158, 163, 166, 70/229, 230; 248/222.52; 403/348, 353
See application file for complete search history.

(56) References Cited

U.S. PATENT DOCUMENTS

| | | | | |
|---|---|---|---|---|
| 72,283 | A | | 12/1867 | Gardner |
| 534,012 | A | | 2/1895 | Saunders |
| 963,883 | A | | 7/1910 | Farley |
| 1,082,790 | A | | 9/1912 | Beshore |
| 1,203,282 | A | | 10/1916 | Uth |
| 1,472,701 | A | | 10/1923 | Vogelaar |
| 1,652,619 | A | | 2/1927 | Fiss |
| 1,796,502 | A | * | 3/1931 | Boucher ..... 109/52 |
| 1,805,759 | A | | 5/1931 | Chamberlain |
| 1,916,509 | A | | 7/1933 | Hammer |
| 2,353,452 | A | | 4/1943 | Fruh |
| 2,754,498 | A | | 7/1956 | Lavelle |
| 2,791,976 | A | | 5/1957 | Kruschwitz |
| 3,347,069 | A | | 10/1967 | Hollingshead |
| 4,029,370 | A | | 6/1977 | Ziegel |
| 4,143,927 | A | | 3/1979 | Spear |
| 4,195,579 | A | * | 4/1980 | Doyel ..... 109/52 |
| 4,244,304 | A | | 1/1981 | Read |
| 4,249,684 | A | | 2/1981 | Miller |
| 4,325,531 | A | | 4/1982 | Omholt |
| 4,457,240 | A | | 7/1984 | Hungerford |
| 4,462,317 | A | | 7/1984 | Franko |
| 4,474,116 | A | | 10/1984 | Castenada |
| 4,493,268 | A | | 1/1985 | Sidler |
| 4,532,783 | A | | 8/1985 | Maurice |
| 4,579,214 | A | | 4/1986 | Volk |
| 4,728,017 | A | | 3/1988 | Mullican |
| 4,821,538 | A | | 4/1989 | Gray |
| 4,926,762 | A | | 5/1990 | Paul |
| 4,951,577 | A | | 8/1990 | Bentley |
| 4,953,374 | A | | 9/1990 | Wiebe |
| 4,987,836 | A | * | 1/1991 | Owen ..... 109/52 |
| 5,170,907 | A | * | 12/1992 | Sakai ..... 220/481 |
| 5,232,303 | A | * | 8/1993 | Rubner ..... 403/330 |
| 5,621,387 | A | | 4/1997 | Phillips |
| 5,651,595 | A | * | 7/1997 | Willis ..... 312/249.2 |
| 5,688,030 | A | * | 11/1997 | McAnally et al. ..... 312/223.2 |
| 5,870,910 | A | | 2/1999 | Specht |

* cited by examiner

*Primary Examiner* — Anthony Stashick
*Assistant Examiner* — Blaine Neway
(74) *Attorney, Agent, or Firm* — Benesch, Friedlander, Coplan & Aronoff LLP

(57) ABSTRACT

Certain embodiments of a secure container are provided herein that are capable of being removably coupled to a surface.

17 Claims, 14 Drawing Sheets

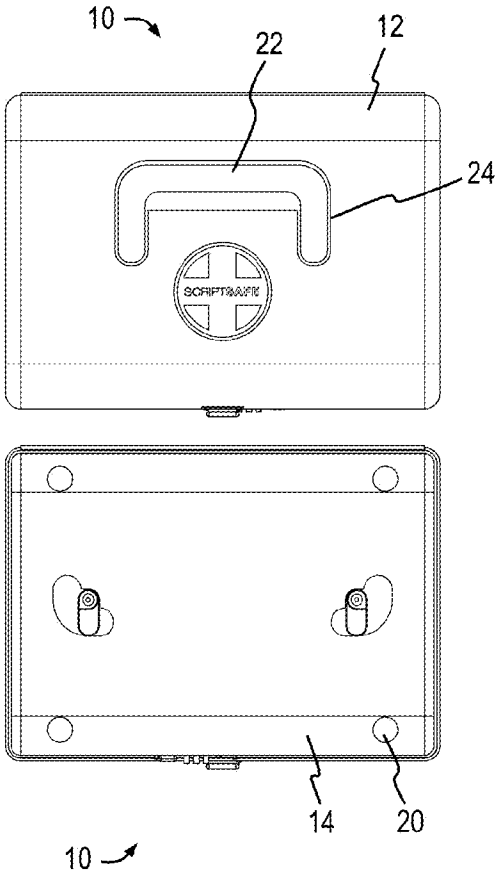
Fig. 1E
Fig. 1C
Fig. 1D
Fig. 1F
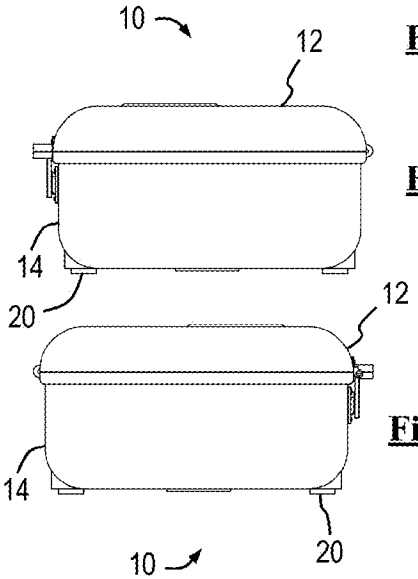
Fig. 1A
Fig. 1B
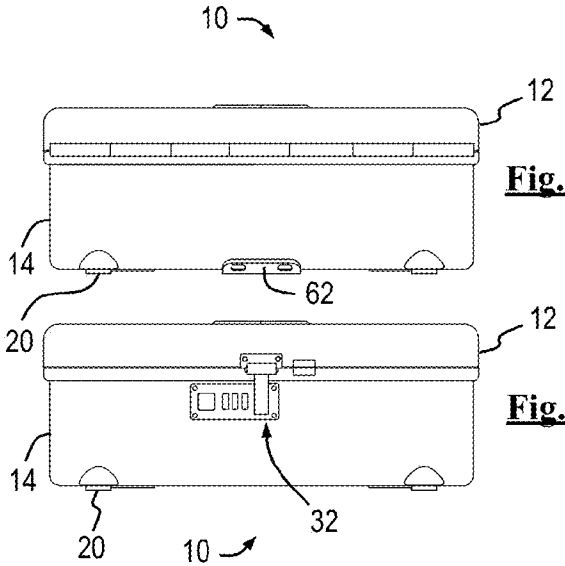

SECURE CONTAINER

CLAIM OF PRIORITY

This application claims priority to U.S. Provisional Application Ser. No. 61/241,417 filed Sep. 11, 2009, the entire disclosure of which is incorporated herein by this reference.

BACKGROUND

Teenage abuse of prescription drugs found in many households is on the rise, owing to the ease of access to these drugs and a lower perceived risk since they are "legal." For this reason medications should be secured to prevent unauthorized access. In addition, for safety and privacy reasons it is desirable to secure medications from others, such as curious youngsters in-laws, housekeepers, childrens' friends, relatives, houseguests, some patients and home service providers, to name a few.

On a similar note, many individuals own or possess a pistol or other firearm for hunting, protection, sport, etc. While such firearms are relatively safe in the possession of law abiding persons knowledgeable in their use, they can be extremely dangerous in the hands of a criminal, a child or other person not qualified for an appropriate use. It is thus desirable to safely and securely store weapons to prevent their theft or misuse.

Likewise, it is desirable to securely and safely store important papers and valuable objects such as money, jewelry and heirlooms.

SUMMARY

According to certain embodiments of the present disclosure a secure container includes at least; a body having a plurality of adjoining faces defining a volume, a complimentary lid hingedly coupled to the body capable of substantially enclosing the volume, an anchor having a distal end portion, a proximal end portion, and a medial portion disposed therebetween, wherein the distal end portion is configured to be coupled to a substantially stationary object, and the proximal end portion has a larger cross-section than the medial portion defining a shoulder at the junction thereof, a clasp coupled to a face of the body and movable relative to the anchor and body, the clasp having an aperture with a first and second end wherein the first end is configured to allow a cross section not substantially larger than that of the medial portion of the anchor to pass therethrough and the second end is configured to allow a cross section not substantially larger than that of the proximal end portion of the anchor to pass therethrough.

It is further contemplated that in certain embodiments, the present disclosure comprises a secure container, wherein the clasp is rotably coupled to the body by a pivot selected from the group of; a pin distinct from the clasp and body which traverses both, a pin integral to the body which traverses the clasp, a pin integral to the clasp which traverses the body, a complimentary shoulder and recess disposed upon the clasp and body, or other rotable coupling means known in the art.

It is further contemplated that in certain embodiments, the present disclosure comprises a secure container, wherein the clasp is slideably coupled to the body It is further contemplated that in certain embodiments, the present disclosure comprises a secure container, wherein the clasp is slideably coupled to the body by a plurality of tabs disposed upon opposing ends of the clasp which extend through and are slideably retained in complimentary elongated apertures on a face of the body.

It is further contemplated that in certain embodiments, the present disclosure comprises a secure container, wherein the clasp is substantially planar.

It is further contemplated that in certain embodiments, the present disclosure comprises a secure container, wherein there is a plurality of anchors and a complimentary plurality of apertures disposed upon a single clasp.

It is further contemplated that in certain embodiments, the present disclosure comprises a secure container, wherein there is a plurality of complimentary anchors and clasps.

It is further contemplated that in certain embodiments, the present disclosure comprises a secure container, wherein there is a complementary detent/recess pair disposed upon the clasp and body configured to provide a temporary mechanical interference therebetween.

It is further contemplated that in certain embodiments, the present disclosure comprises a secure container, wherein the distal-most portion of the anchor is substantially planar and substantially larger than the medial and proximal diameters.

It is further contemplated that in certain embodiments, the present disclosure comprises a secure container, wherein the anchor is secured to a surface by a mounting selected from the group of; a screw, a pin, adhesive, molding, over-molding, press-fitting, or other coupling means known in the art.

It is further contemplated that in certain embodiments, the present disclosure comprises a secure container, wherein there is an aperture disposed upon a face of the body operatively configured to receive a chain or cable therein.

It is further contemplated that in certain embodiments, the present disclosure comprises a secure container, wherein there is carrying handle pivotably coupled to the lid.

It is further contemplated that in certain embodiments, the present disclosure comprises a secure container, wherein there is a closure configured to temporarily fix the lid to the body, wherein the closure is selected from the group of; a hinged latch/eyelet pair, a keyed tumbler, a combination lock, or other temporary closure means known in the art.

It is further contemplated that in certain embodiments, the present disclosure comprises a secure container, wherein there are complementary apertures which traverse the lid and body without exposing the volume thereby defining a carrying handle.

It is further contemplated that in certain embodiments, the present disclosure comprises a secure container, wherein the clasp is disposed within a recess in a face of the body.

It is further contemplated that in certain embodiments, the present disclosure comprises a secure container, wherein there is a projection in substantially co-planar relation to the clasp extending orthogonally therefrom, operatively configured to be acted upon by a user.

It is further contemplated that in certain embodiments, the present disclosure comprises a secure container, wherein the shoulder is defined by the head of a screw, bolt, or other securing means.

It is further contemplated that in certain embodiments, the present disclosure comprises a second secure container including at least a body having a plurality of adjoining faces defining a volume, a complimentary lid hingedly coupled to the body capable of substantially enclosing the volume, an anchor having a distal end portion, a proximal end portion, and a medial portion disposed therebetween, wherein the distal end portion is configured to be pivotably coupled to a substantially stationary object, and the proximal end portion has a substantially larger cross-section than the medial portion, there is a complimentary aperture disposed upon a face of the body configured to allow the anchor to pass therethrough only along a part of the anchor's rotational path thereby providing a configuration in which the anchor may be temporarily retained therein.

It is further contemplated that in certain embodiments, the present disclosure comprises a second secure container wherein the anchor is rotably coupled to the substantially stationary object by a pivot selected from the group of; a pin distinct from the anchor and object which traverses both, a pin integral to the object which traverses the anchor, a pin integral to the anchor which traverses the object, a complimentary shoulder and recess disposed upon the anchor and body, or other rotable coupling means known in the art.

It is further contemplated that in certain embodiments, the present disclosure comprises a second secure container, wherein there is a bearing disposed between the pivot and the anchor.

It is further contemplated that in certain embodiments, the present disclosure comprises a second secure container, wherein the pivot is configured to occupy a substantial portion of the aperture in the body, laterally fixing the anchor thereagainst.

It is further contemplated that in certain embodiments, the present disclosure comprises a second secure container, wherein there is a complementary detent/recess pair disposed upon the clasp and body configured to provide a temporary mechanical interference therebetween.

It is further contemplated that in certain embodiments, the present disclosure comprises a second secure container, wherein there is a plurality of complimentary anchor/aperture pairs.

It is further contemplated that in certain embodiments, the present disclosure comprises a second secure container, wherein there is an aperture disposed upon a face of the body operatively configured to receive a chain or cable therein.

It is further contemplated that in certain embodiments, the present disclosure comprises a second secure container, wherein there is carrying handle pivotably coupled to the lid.

It is further contemplated that in certain embodiments, the present disclosure comprises a second secure container, wherein there is a closure configured to temporarily fix the lid to the body, wherein the closure is selected from the group of; a hinged latch/eyelet pair, a keyed tumbler, a combination lock, or other temporary closure means known in the art.

It is further contemplated that in certain embodiments, the present disclosure comprises a second secure container, wherein there are complementary apertures which traverse the lid and body without exposing the volume thereby defining a carrying handle.

It is further contemplated that in certain embodiments, the present disclosure comprises a second secure container, wherein the distal-most portion of the anchor is substantially planar and substantially larger than the medial and proximal diameters.

It is further contemplated that in certain embodiments, the present disclosure comprises a second secure container, wherein the proximal portion of the anchor is disposed in a recess in the face of the body.

It is further contemplated that in certain embodiments, the present disclosure comprises a second secure container, wherein the anchor is secured to a surface by a mounting selected from the group of; a screw, a pin, adhesive, molding, over-molding, press-fitting, or other coupling means known in the art.

It is further contemplated that in certain embodiments, the present disclosure comprises a second secure container, wherein the shoulder is defined by the head of a screw, bolt, or other securing means.

BRIEF DESCRIPTION OF THE FIGURES

In the figures, which are not necessarily drawn to scale, like numerals describe substantially similar components throughout the several views. The drawings illustrate generally, by way of example, but not by way of limitation, various embodiments discussed in the claims of the present document.

FIGS. 1A, 1B, 1C, 1D, 1E and 1F show rear, front, right-side, left-side, top and bottom views respectively of a secure container according to an embodiment of the present invention;

DETAILED DESCRIPTION OF THE FIGURES

Figure 2:
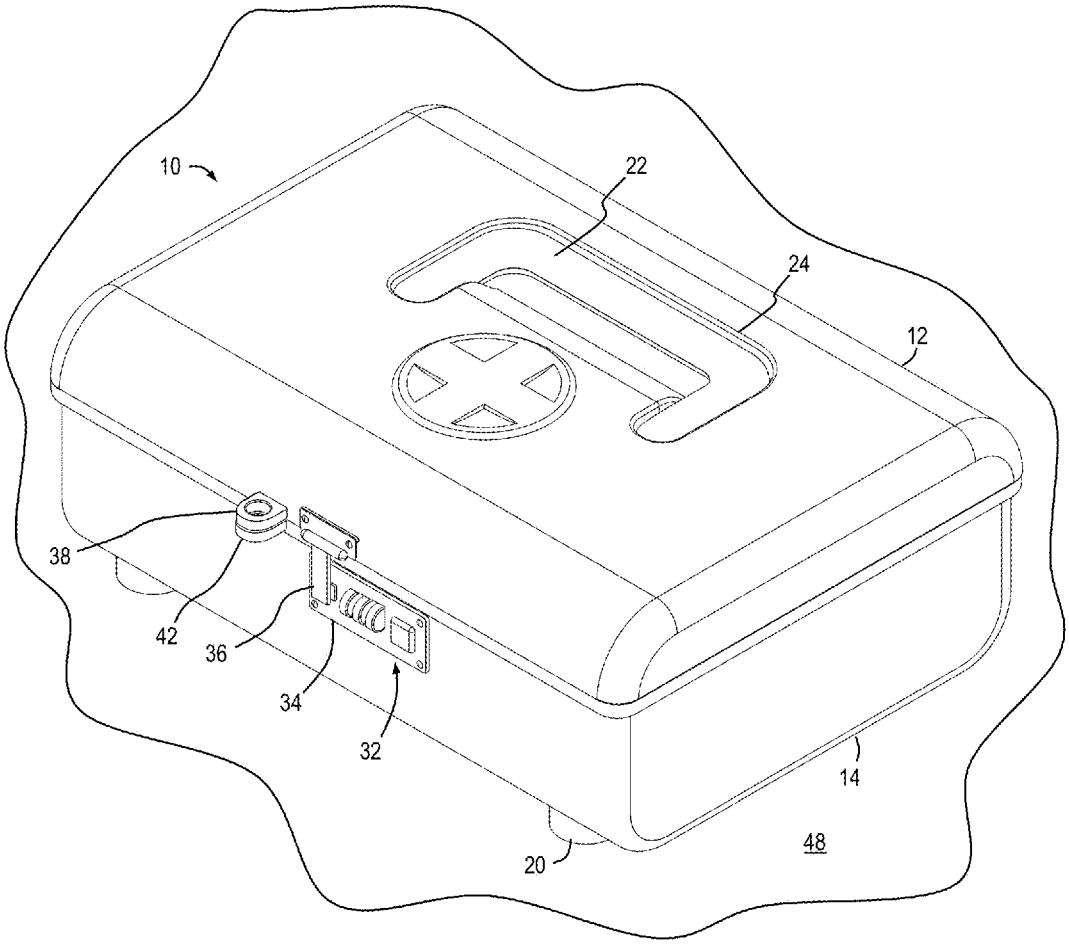
FIG. 2 shows the secure container of FIGS. 1A-1F in a closed condition.
Figure 3:
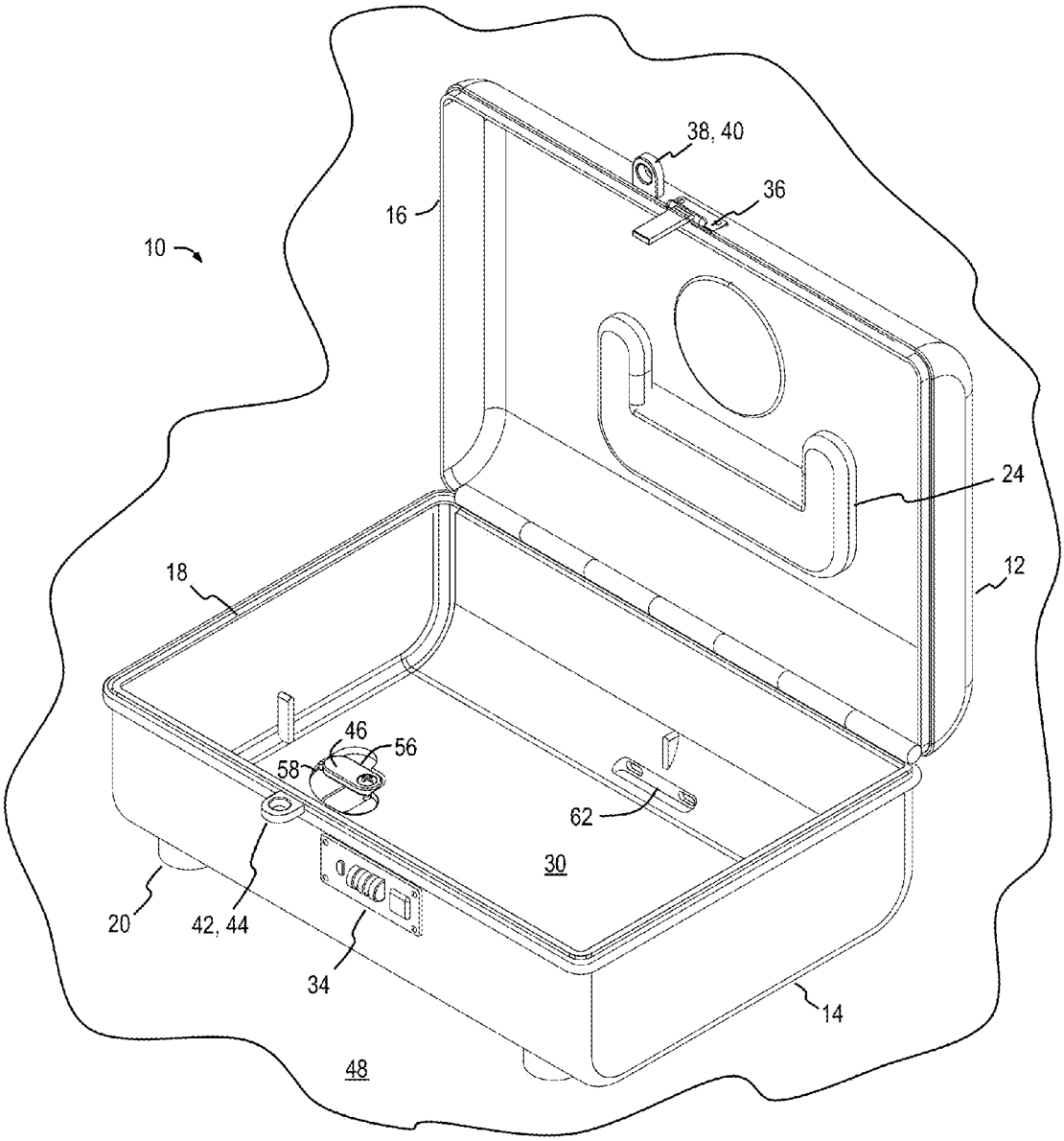
FIG. 3 shows the container of FIGS. 1A-1F in an open condition.

The general arrangement of a secure container 10 is shown in FIGS. 1A-1F, 2 and 3 according to an embodiment of the present invention. Container 10 comprises an upper housing portion 12 hingedly attached to a lower housing portion 14. Housing portions 12, 14 may be made from any suitable materials including, without limitation, ABS or polycarbonate plastic, metal, and composite materials. In some embodiments the edges of housing portions 12, 14 may include a matable tongue and groove. In FIG. 3 an edge of upper housing portion 12 includes a tongue 16 configured to mate to a groove 18 of lower housing portion 14, although the tongue and groove may be reversed in the housing portions or even omitted if desired.

A set of legs 20 are positioned proximate each corner of lower housing portion 14 and extend away therefrom. Legs 20 may be formed integral to lower housing portion 14 or may be made separately and attached thereto. Legs 16 may further comprise rubber or felt pads (not shown).

Upper housing portion 12 includes a stowable handle 22. Handle 22 is pivotably attached to upper housing portion 12 and stows into a cavity 24 generally flush with the upper housing portion in the stowed position. Handle 22 may be made from any suitable materials including, without limitation, ABS or polycarbonate plastic, metal, and composite materials.

Figure 4:
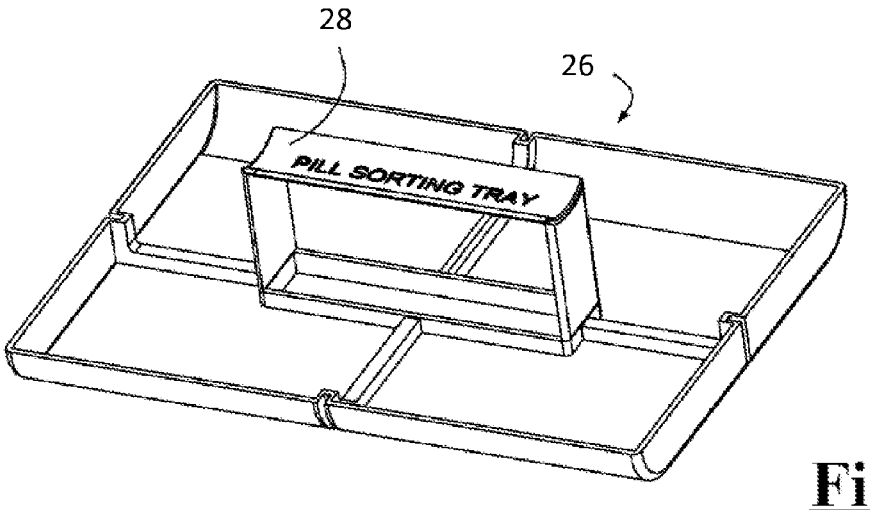
FIG. 4 shows a removable tray configured to fit within the container of FIGS. 1A-1F according to an embodiment of the present invention.
Figure 5:
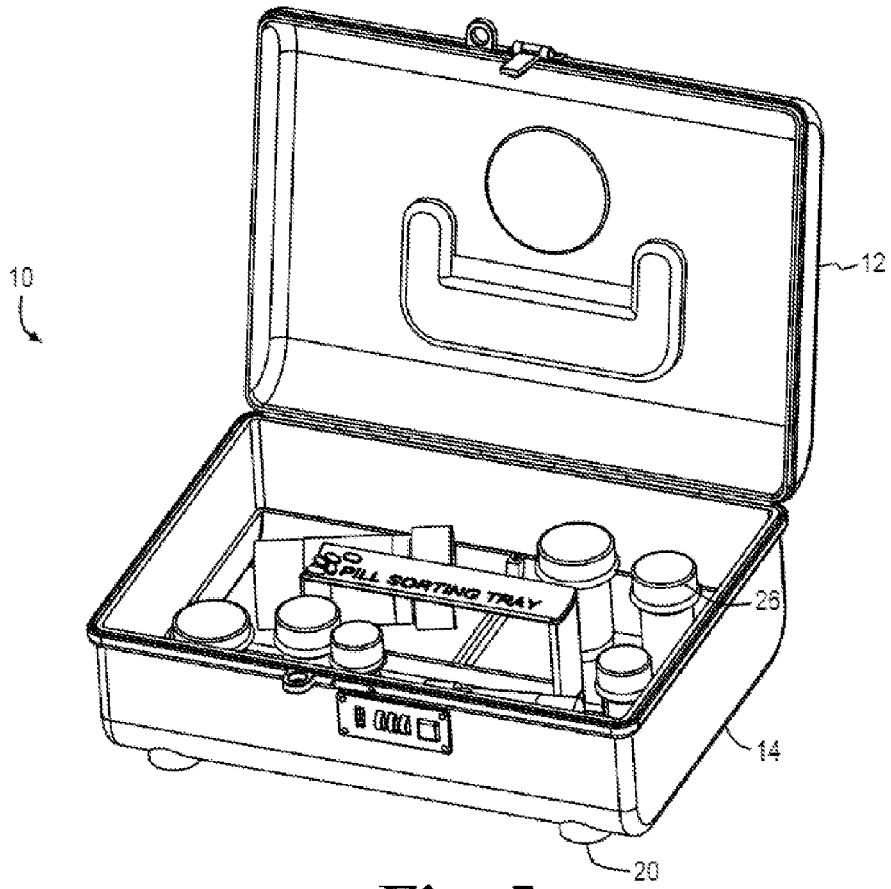
FIG. 5 shows the removable tray of FIG. 4 installed into the container of FIGS. 1A-1F.

A tray 26 is shown in FIG. 4 according to an embodiment of the present invention. Tray 26 is divided into quadrants to facilitate organization of medicines, although a smaller or greater number of dividers may be selected if desired. Tray 26 also includes a pill sorting portion 28 which doubles as a carrying handle for the tray. Tray 26 is configured to be removably installed into container 10, resting against a bottom 30 of lower housing portion 14, as shown in FIG. 5. Tray 26 may be made from any suitable materials including, without limitation, ABS or polycarbonate plastic, metal, and composite materials.

With reference again to FIGS. 2 and 3, container 10 includes a combination lock 32 having a user-settable combination. A lock tumbler 34 is attached to lower housing portion 14, while a biased lock latch 36 is attached to upper housing portion 12. Latch 36 is lockably engageable to tumbler 34 to selectably secure upper housing portion 12 to lower housing portion 14.

With continued reference to FIGS. 2 and 3, upper housing portion 12 includes a first tab 38 having a first opening 40 therethrough. Likewise, lower housing portion 14 includes a second tab 42 having a second opening 44 therethrough, the first and second tabs and openings being generally alignable. Openings 40, 44 are configured to receive a padlock (not shown) therethrough when container 10 is in a closed condition (FIG. 2) to further, or in the alternative, secure the container by locking together upper housing portion 12 and lower housing portion 14.

Figure 6A:
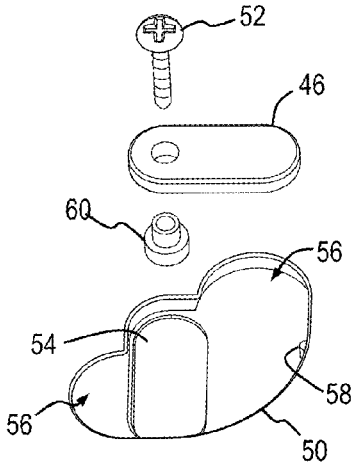
FIGS. 6A and 6B show a system for releasably securing the container of FIGS. 1A-1F to a surface according to an embodiment of the present invention.
Figure 6B:
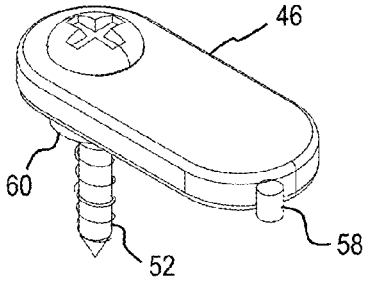

With reference to FIGS. 3, 6A and 6B together, lower housing portion 14 may further include a set of locking flanges 46 to secure container 10 to a mounting surface 48 such as a wooden or composite shelf. Each locking flange 46 fits into an arcuate cavity 50, which has a depth such that flange 46 is generally flush with bottom 30 of lower housing portion 14. Flange 46 is pivotable about a mounting screw 52 and is selectably positionable to fit through an opening 54 in cavity 50 in an unlocked condition. Cavity 50 includes a pair of finger holds 56 and a protrusion 58 to selectably retain flange 46 in a locked condition, as shown in FIG. 6A. A bushing 60 may be used to control the spacing of flange 46 from mounting surface 48, as shown in FIG. 6A.

In use, flanges 46 are attached to mounting surface 48 with mounting screws 52 and bushings 60, as generally shown in FIG. 6A. Each flange 46 is then pivoted about mounting screw 52 so that the flange is aligned with and fits through corresponding opening 54 into cavity 50. Flange 46 is then pivoted to a locked position past protrusion 58 which provides sufficient interference to retain the flange in the locked position. In this condition container 10 is secured to mounting surface 48 by flanges 46. As can be seen from FIGS. 2 and 3, locking flanges are accessible only when container 10 is unlocked and open. Container 10 may be subsequently detached from mounting surface 48 by unlocking and opening the container, removing tray 26, then pivoting locking flanges 46 to align with openings 54. Container 10 may then be detached from mounting surface 48, flanges 46 passing through openings 54 as the container is moved away from the mounting surface. Press-fit plugs or the like (not shown) may optionally be provided to cover the openings 54 when the container 10 is disengaged from the corresponding locking flanges 46.

Figure 7:
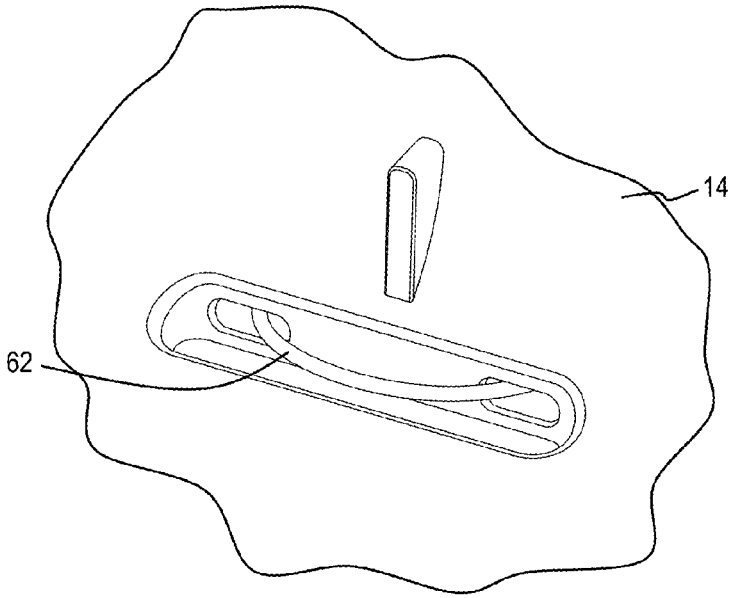
FIGS. 7 and 8 show a cable lock for use with the container of FIGS. 1A-1F according to an embodiment of the present invention.
Figure 8:
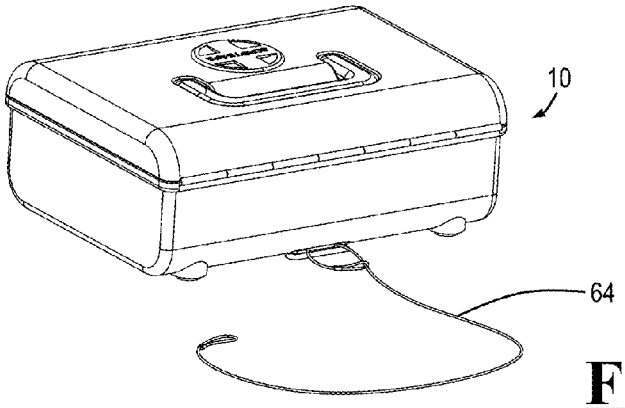

With reference to FIGS. 7 and 8, in some embodiments of the present invention a cable lock 62 may be provided, to which a cable 64 may be attached and secured to a sturdy structure (not shown).

Figure 9A:
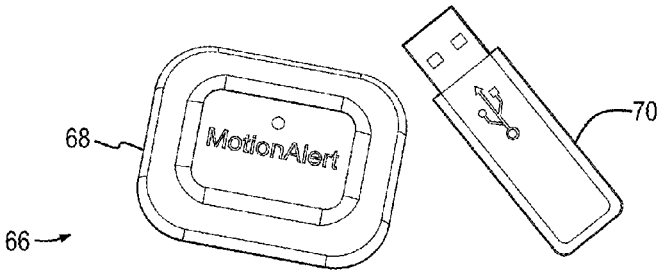
FIGS. 9A and 9B show an alarm configured for use with the container of FIGS. 1A-1F according to an embodiment of the present invention
Figure 9B:
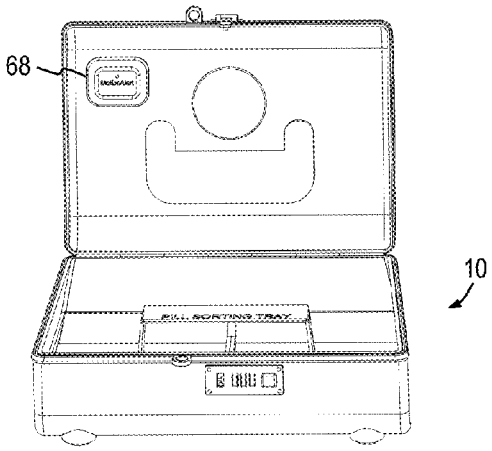
Figure 12:
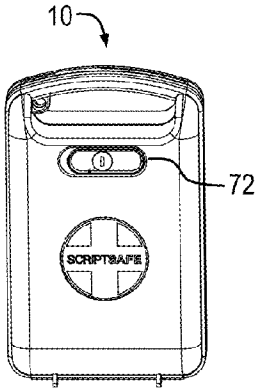
FIGS. 10, 11, 12, 13, 14 and 15 show the general arrangement of example configurations of secure containers according to various embodiments of the present invention.
Figure 11:
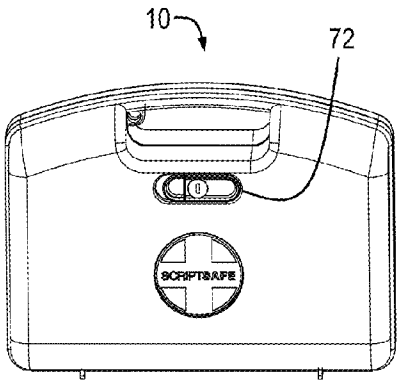
Figure 10:
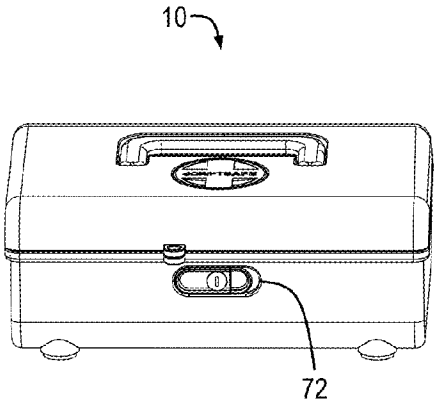
Figure 13:
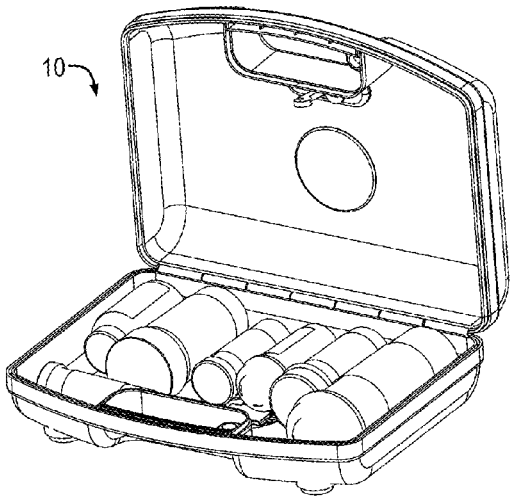
Figure 14:
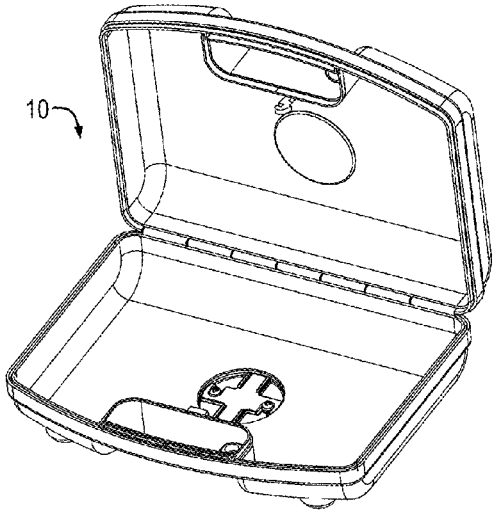
Figure 15:
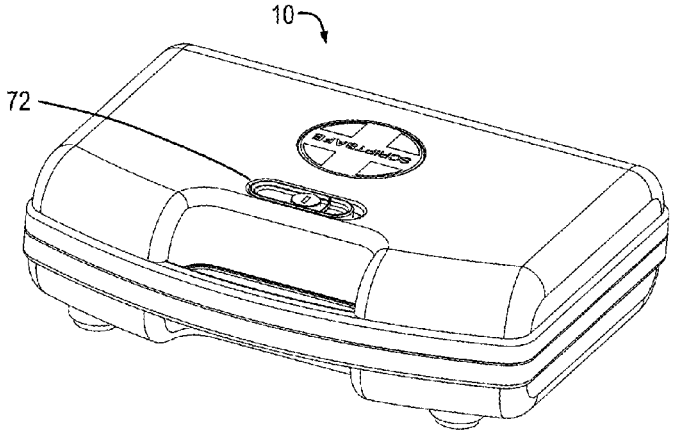

With reference to FIGS. 9A and 9B, in one embodiment of the present invention container 10 may include a security system 66 comprising a transmitter 68 and a receiver 70. Transmitter 66 is installed inside container 10 and is configured to generate an alarm signal if the container is subjected to a shock or is moved. The alarm signal may be aural, and/or may include a wireless signal transmitted to receiver 70. Upon receipt of the alarm signal receiver 70 may likewise generate an aural signal and/or a visual signal. Receiver 70 may also be connected to a computer (not shown), in which case a computer program executed by the computer may respond by taking one or more predetermined actions. Predetermined actions may include, without limitation, one or more of sending a text message alert, sending a voicemail alert, sending a paged alert, sending an e-mail alert and recording in the computer memory data relating to the alarm signal.

In some embodiments of the present invention container 10 may further include a multi-sheet, tear-away notepad to aid users in monitoring, dispensing and disposing of medications. The notepad comprises an inventory log listing such information as the medications contained in container 10, an inventory of the number of pills, the expected completion date for the medications, dispensing instructions, the number of pills used, and notes regarding the medications. The log thus implements a system for accounting for properly using medications, as well as providing convenient indications regarding when the user should dispose of medications.

Several example configurations of secure container 10 are shown in FIGS. 10 through 15 according to various embodiments of the present invention. These configurations are for illustrative purposes only and are not intended to be limiting in any way. The secure containers 10 of FIGS. 10 through 15 include a key lock 72 which may be substituted for the combination lock 32 described above.

Figure 16:
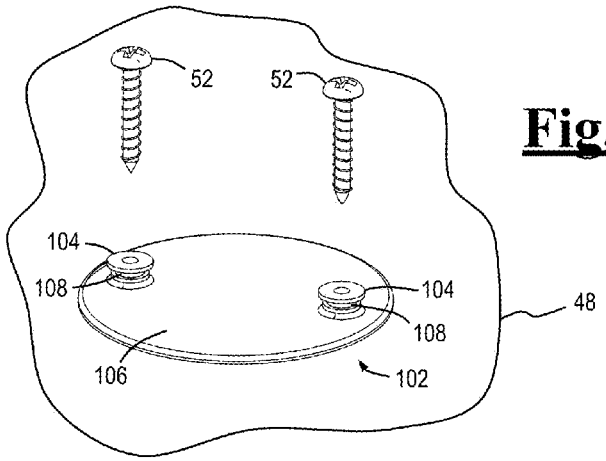
FIGS. 16, 17A and 17B show a system for releasably securing a container to a surface according to an alternate embodiment of the present invention.
Figure 17A:
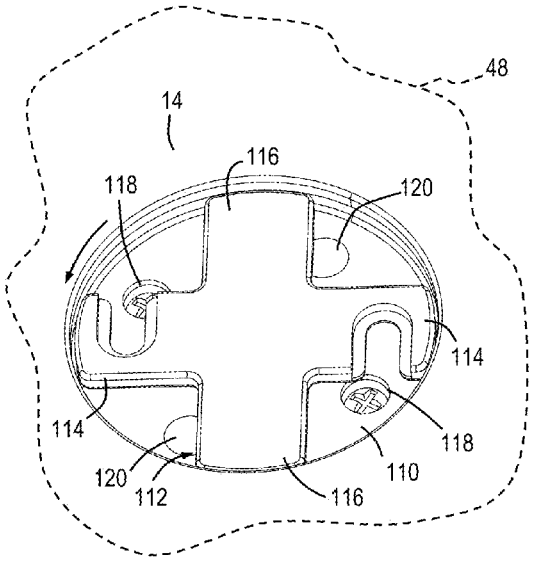
Figure 17B:
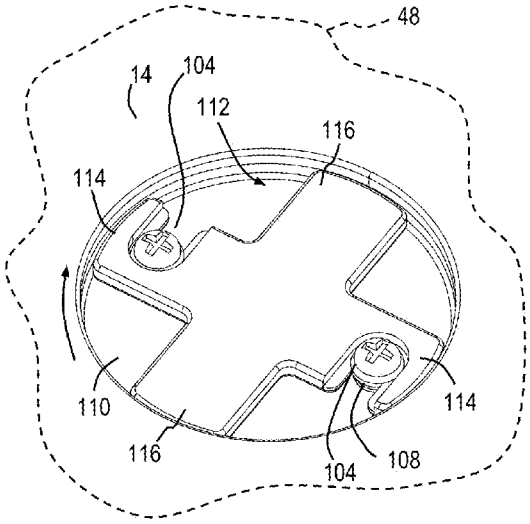

A system for selectably securing container 10 to a mounting surface 48 is shown in FIGS. 16, 17A and 17B according to an alternate embodiment of the present invention. A mount 102 includes a pair of spaced-apart mounting protrusions 104 extending away from a generally planar base 106. Mounting protrusions 104 each include an undercut portion 108. Mount 102 is attached to mounting surface 48 with fasteners such as screws 52 that are inserted through apertures formed in mounting projections 104 and attached to the mounting surface, as shown in FIG. 16.

With reference to FIGS. 17A and 17B, in this embodiment of container 10 the interior of lower housing portion 14 includes a generally circular recess 110 into which a locking element 112 having a set of locking tabs 114 and a set of opposing members 116 is rotatably attached. Recess 110 also includes a set of spaced-apart openings 118.

In operation, locking element 112 is rotated to a position such that locking tabs 114 of locking element 112 are clear of openings 118 (FIG. 17A). Container 10 is positioned atop mount 102 such that mounting protrusions 104 extend through corresponding openings 118 of lower housing portion 14 (FIG. 17A). Locking element 112 is then rotated so that locking tabs 114 engage corresponding undercut portions 108 of mount 102, thereby securing container 10 to mounting surface 48 (FIG. 17B). In this position members 116 of locking element 112 are urged over and rest against a set of corresponding stops 120 formed in or attached to recess 110 (FIG. 17B), the stops providing sufficient friction between the locking element and the lower housing portion to prevent unintentional disengagement of locking tabs 114 from protrusions 104.

Figure 18:
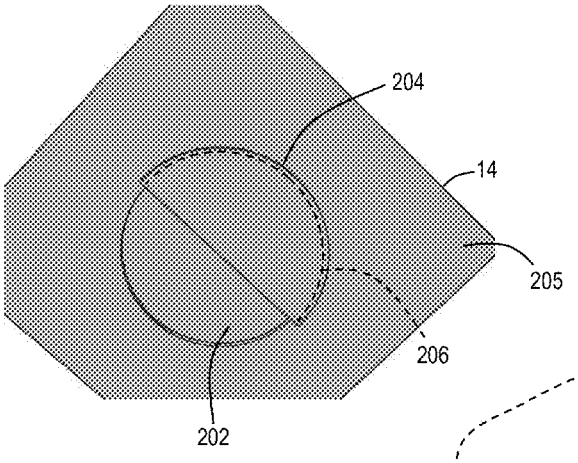
FIGS. 18, 19A and 19B show a system for releasably securing a container to a surface according to another alternate embodiment of the present invention.
Figure 19B:
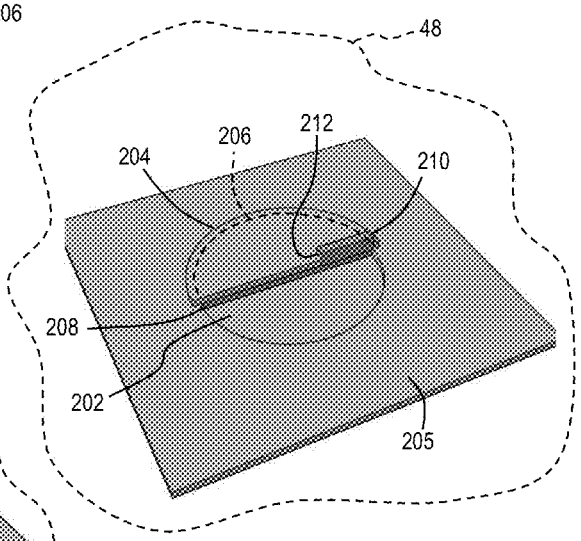
Figure 19A:
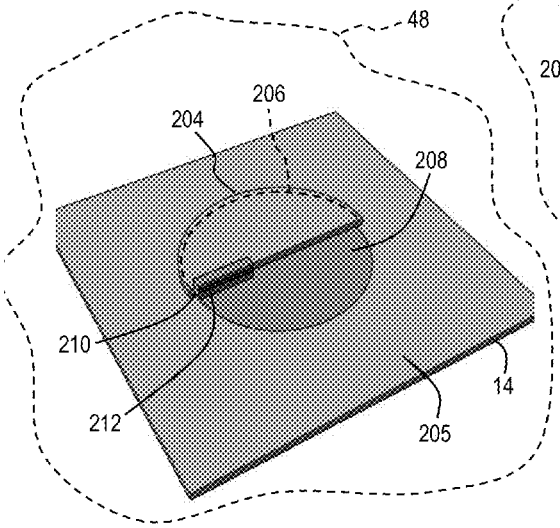
Figure 20:
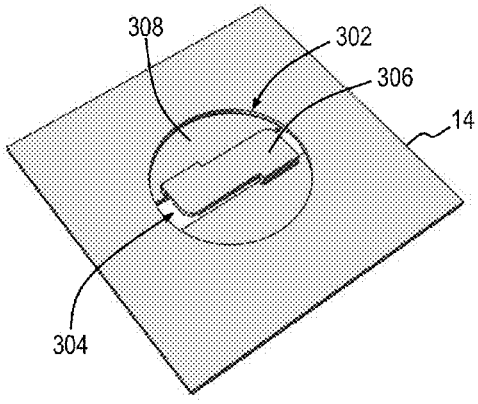
FIGS. 20, 21, 22, 23A and 23B show a system for releasably securing a container to a surface according to yet another alternate embodiment of the present invention.
Figure 21:
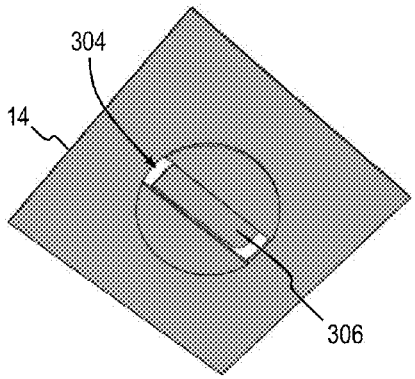
Figure 22:
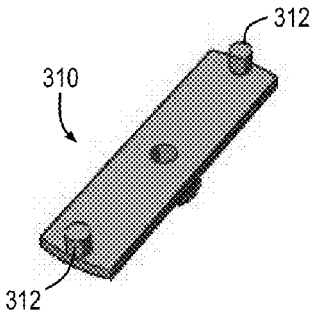

A system for selectably securing container 10 to a mounting surface 48 is shown in FIGS. 18, 19A and 19B according to another alternate embodiment of the present invention. Lower housing portion 14 includes an opening 202 generally in the shape of a half-circle. A mount 204, also having a general shape of a half-circle, is within the interior of lower housing portion 14, is oriented opposite opening 202, and is spaced apart from an interior surface 205 of lower housing portion 14, forming a cavity 206. A locking element 208 generally having the shape of a half-circle is rotatably attached to mounting surface 48. Locking element 208 further includes a locking tab 210.

In operation, container 10 is positioned atop locking element 208 such that the locking element extends through opening 202 (FIG. 19A). Locking element 208 is then rotated into cavity 206, a groove or undercut 212 of locking tab 210 engaging mount 204, thereby securing container 10 to mounting surface 48 (FIG. 19B).

Figure 23A:
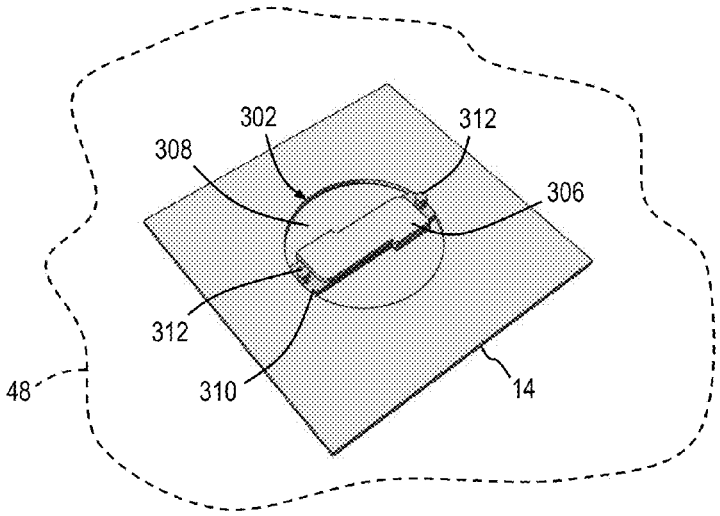
Figure 23B:
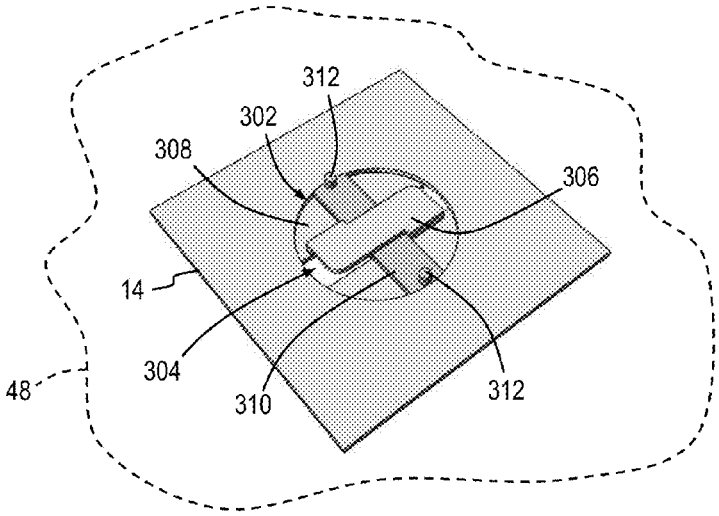

A system for selectably securing container 10 to a mounting surface 48 is shown in FIGS. 20, 21, 22, 23A and 23B according to yet another alternate embodiment of the present invention. A generally circular recess 302 within the interior of lower housing portion 14 includes a slot 304. A retaining member 306 is oriented over slot 304 and is spaced apart from a surface 308 of recess 302. A locking element 310 having a set of locking protrusions 312 (FIG. 22) is rotatably attached to a mounting surface 48 (FIGS. 23A, 23B).

In operation, container 10 is positioned over locking element 310 such that the locking element and protrusions 312 extend through slot 304 and into the container (FIG. 23A). Locking element 310 is then rotated to engage surface 308, thereby securing container 10 to mounting surface 48 with retaining member 306.

Figure 24:
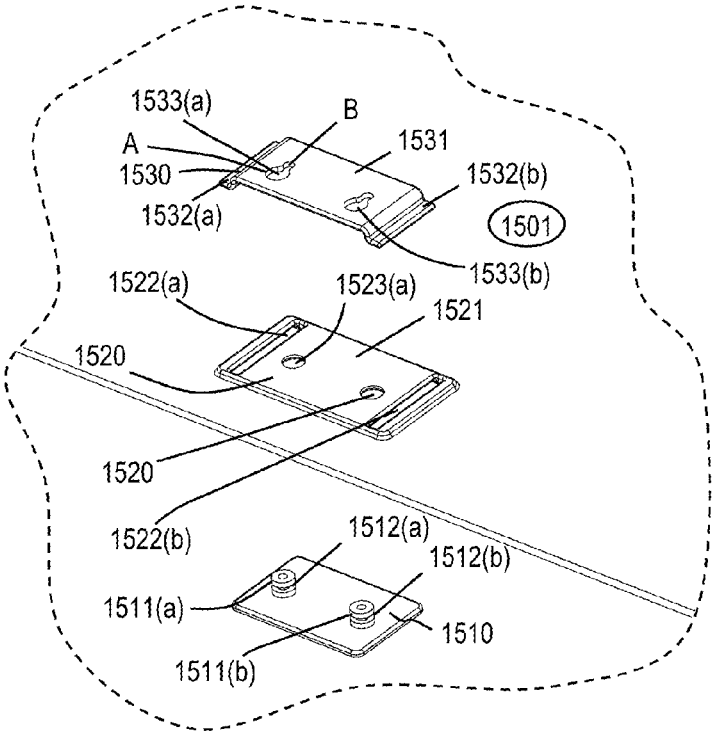
FIGS. 24, 25, and 26 show a system for releasably securing a container to a surface according to yet another alternate embodiment of the present invention.

Referring now to FIG. 24, a further embodiment of the present disclosure is shown, wherein the locking mechanism 1501 of a secure container 1500 comprises a fixing component 1510, a body component 1520, and a sliding component 1530.

Fixing component 1510 is a substantially planar member two mating extrusions 1511(*a* and *b*) disposed thereupon. Mating extrusions 1511(*a* and *b*) are annular, substantially round extrusions having a substantially reduced cross-section upon a medial portion thereof defining shoulders 1512(*a* and *b*) thereupon.

Body component 1520 a substantially embossed portion of face of the casing of a container defining an elevated face 1521. Elevated face 1520 has slide portions 1522(*a* and *b*) removed therefrom. Slide portions 1522(*a* and *b*) comprise elongated apertures operatively configured to define a path for the motion of sliding component 1530 therein. Elevated face 1520 has anchor apertures 1523(*a* and *b*) removed therefrom and operatively configured to allow passage of the larger portion of mating extrusions 1511(*a* and *b*) therethrough.

Sliding component 1530 is a substantially planar member comprising a primary face 1531, bearing faces 1532(*a* and *b*), and apertures 1533(*a* and *b*). Primary face 1531 is substantially planar having apertures 1533(*a* and *b*) disposed thereupon. Apertures 1533(*a* and *b*) have a first diameter A and a second diameter B oriented parallel to slide portions 1522(*a* and *b*). A is configured to allow passage of the larger diameter of mating extrusion 1511(*a* and *b*) therethrough, while B is configured to only allow passage of the smaller diameter mating extrusion 1511(*a* and *b*) therethrough. Bearing faces 1532(*a* and *b*) are substantially co-planar faces disposed in substantially parallel relation to primary face 1531.

A method of using a locking mechanism 1501 will now be disclosed. Initially, a user secures a fixing component 1510 to a substantially stationary surface using known methods in the arts, including for instance adhesive, screws, or bolts. Next, a secure container 1500 is provided in a first configuration wherein section A of apertures 1533(*a* and *b*) is in substantially concentric relation with apertures 1523(*a* and *b*). Next, a user orients secure container directly over fixing component such that mating extrusions 1511(*a* and *b*) are in substantially co-planar and concentric relation with apertures 1523(*a* and *b*). Next, a user brings secure container 1500 towards fixing component 1510, thereby extended mating extrusions 1511(*a* and *b*) through apertures 1523(*a* and *b*). Next, a user displaces sliding portion 1530 about its path such that section B of apertures 1533(*a* and *b*) comes into substantially concentric relation and with shoulders 1512(*a* and *b*) providing mechanical interference thereagainst and consequently temporarily coupling secure container 1500 to fixing component 1510.

Figure 25:
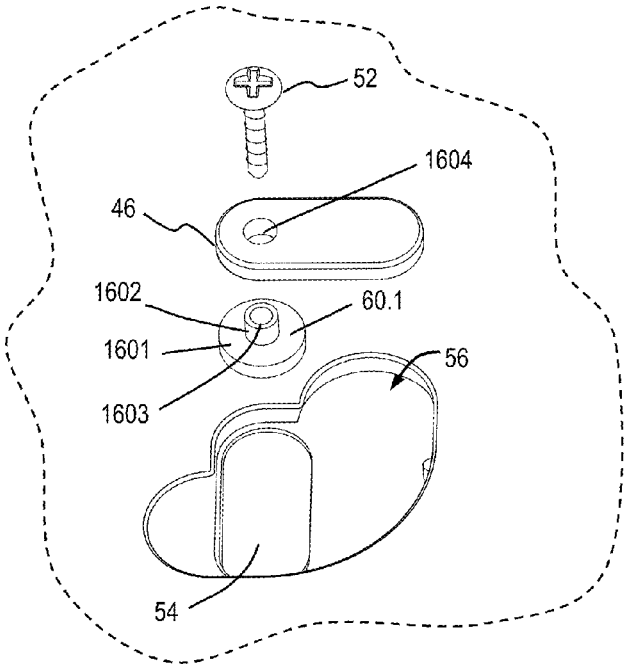
Figure 26:
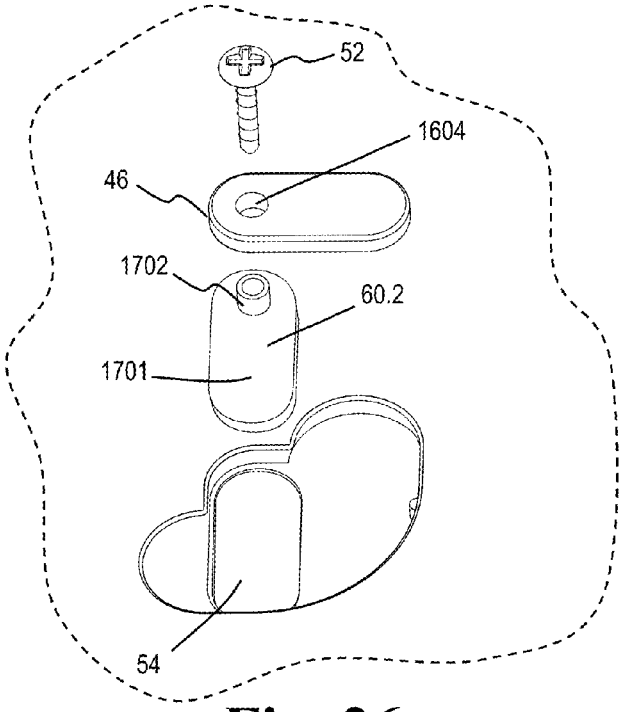

Referring now to FIGS. 25 and 26, further embodiments of the embodiment of present disclosure shown in FIGS. 3, 6A and 6B and described in detail above are shown wherein bushing 60 has a cross-section substantially larger than that of the aperture disposed upon the face of flanges 46.

In the embodiment shown FIG. 25, bushing 60.1 is a substantially round, annular member having a distal end portion 1601 and a proximal end portion 1602. The outer diameter of proximal end portion 1602 is defined by the diameter of aperture 1604 disposed upon flanges 46, while the inner diameter of proximal end portion 1602 is defined by the diameter of the shaft of mounting screw 52. The outer diameter of distal end portion 1601 is defined by the diameter of opening 54, while the inner diameter of distal end portion 1601 is defined by the diameter of the shaft of mounting screw 52.

In the embodiment shown in FIG. 26, bushing 60.2 is substantially planar, annular member having a distal end portion 1701 and a proximal end portion 1702. The outer diameter of proximal end portion 1702 is defined by the diameter of aperture 1604 disposed upon flanges 46, while the inner diameter of proximal end portion 1702 is defined by the diameter of the shaft of mounting screw 52. The outer diameter of distal end portion 1701 is defined by the shape of opening 54, while the inner diameter of distal end portion 1701 is defined by the diameter of the shaft of mounting screw 52.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A secure container, comprising:

an upper housing portion;

a lower housing portion, wherein the lower housing portion is hingedly attached to the upper housing portion;

a mount comprising a mounting protrusion and a base;

wherein the mounting protrusion comprises: a distal end portion connected to the base, a proximal end portion, and a medial portion disposed between the distal end portion and the proximal end portion, wherein the proximal end portion has a larger cross-section than the medial portion and wherein a junction of the proximal end portion and the medial portion forms a shoulder, and wherein the base is configured to be coupled to a substantially stationary object; and a locking element comprising at least two apertures, wherein the at least two apertures are integrally formed in the locking element, wherein the locking element is disposed within a circular recess on an interior surface of the lower housing portion and is rotatably connected to the lower housing portion and secured to the lower housing portion by a mateable connection between a ridge on an outer periphery of the locking element and an annular groove on a periphery of the circular recess, wherein the locking element is not accessible from an exterior of the upper housing portion and from an exterior of the lower housing portion, and wherein the at least two apertures comprise a first end and a second end, wherein the first end comprises a width not substantially larger than the cross-section of the medial portion, and wherein the second end comprises a width not substantially larger than the cross-section of the proximal end portion.

2. The secure contained of claim 1, wherein the locking element is configured to selectively engage the mounting protrusion.

3. The secure container of claim 1, wherein the at least two apertures are configured to engage the mounting protrusion.

4. The secure contained of claim 1, wherein the mount comprises at least two mounting protrusions, and wherein the at least two mounting protrusions are configured to engage the at least two apertures.

5. The secure container of claim 2, wherein the lower housing portion comprises at least one stop configured to prevent an unintentional disengagement of the locking element from the mounting protrusion.

6. The secure container of claim 1, wherein the base comprises a larger diameter than the medial portion.

7. The secure container of claim 1, wherein the base is configured to be coupled to a substantially stationary object by at least one of: a screw, a pin, an adhesive, a molding, an over-molding, and a press-fitting.

8. The secure container of claim 1, wherein the shoulder comprises at least one of a head of a screw or a head of a bolt.

9. The secure container of claim 1, wherein the upper housing portion comprises a handle.

10. The secure container of claim 1, further comprising a latch connected to the upper housing portion and the lower housing portion.

11. The secure container of claim 1, further comprising a tray.

12. A secure container, comprising:

a lower housing portion;

a mount comprising at least two mounting protrusions and a base, wherein the at least two mounting protrusions comprise: a distal end portion connected to the base, a proximal end portion, and a medial portion disposed between the distal end portion and the proximal end portion, wherein the proximal end portion has a larger cross-section than the medial portion and wherein a junction of the proximal end portion and the medial portion forms a shoulder; and a locking element comprising at least two apertures, wherein the at least two apertures are integrally formed in the locking element, wherein the locking element is disposed within a circular recess on an interior surface of the lower housing portion and is rotatably connected to the lower housing portion and secured to the lower housing portion by a mateable connection between a ridge on an outer periphery of the locking element and an annular groove on a periphery of the circular recess, wherein the locking element is not accessible from an exterior of the lower housing portion, and wherein the at least two apertures comprise a first end and a second end, wherein the first end comprises a width not substantially larger than the cross-section of the medial portion, and wherein the second end comprises a width not substantially larger than the cross-section of the proximal end portion.

13. The secure container of claim 12, further comprising an upper housing portion hingedly attached to the lower housing portion.

14. The secure container of claim 12, wherein the base is configured to be coupled to a substantially stationary object.

15. The secure container of claim 12, wherein the locking element is configured to selectively engage that at least two mounting protrusions.

16. The secure container of claim 12, wherein the at least two apertures are configured to engage the at least two mounting portions.

17. The secure container of claim 12, wherein the shoulder comprises at least one of a head of screw or a head of a bolt.

* * * * *